United States Patent [19]

Nicolaisen et al.

[11] 4,034,327

[45] July 5, 1977

[54] TIMING PULSE GENERATING SWITCH

[75] Inventors: Holger Nicolaisen; Finn Schnoor Andersen, both of Nordborg; Leif Borge Tandrup, Sonderborg, all of Denmark

[73] Assignee: Danfoss A/S, Nordborg, Denmark

[22] Filed: Oct. 22, 1975

[21] Appl. No.: 624,846

[30] Foreign Application Priority Data

Oct. 28, 1974 Germany ..... 2451090

[52] U.S. Cl. ..... 337/41; 337/49; 337/339

[51] Int. Cl.² ..... H01H 61/00; H01H 71/16

[58] Field of Search ..... 337/41–44, 337/45, 46, 49, 53, 55, 56, 57, 335, 338, 339; 431/78

[56] References Cited

UNITED STATES PATENTS

| | | | |
|---|---|---|---|
| 2,498,127 | 2/1950 | Kuhn | 337/41 X |
| 3,258,565 | 6/1966 | Them | 337/42 |
| 3,634,801 | 1/1972 | Gould et al. | 337/41 |

*Primary Examiner*—Harold Broome

[57] ABSTRACT

The invention relates to a timing pulse generating switch assembly, particularly for the monitoring circuit of an oil or gas furnace, having at least one snap switch provided with a contact arm which carries the movable contact. The movable contact arm is fixed with respect to the housing at one end and there is provided a snap system which adjusts the contact arm. The snap system possesses a snap arm which is fixed with respect to the housing at one end and is preferably formed by the contact arm. The snap system includes a snap spring which is articulated to the snap arm and, at its other end, is articulated to a slide that is reciprocatable by a bimetallic member. The switch assembly includes and is influenced by a locking element that is actuated by separate means such as the armature of a relay. The locking element functions to block the movable contact in its rest position as well as in its operating position by using a blocking member which is carried along by the slide.

4 Claims, 10 Drawing Figures

TIMING PULSE GENERATING SWITCH

The invention relates to a timing pulse generating switch, particularly for the monitoring circuit of an oil or gas furnace, comprising at least one snap switch provided with a contact arm which carries the movable contact and is fixed with respect to the housing at one end and with a snap system which adjusts the contact arm, wherein the snap system possesses a snap arm which is fixed with respect to the housing at one end and is preferably formed by the contact arm and also possesses a snap spring which is articulated to the snap arm and, at its other end, is articulated to a slide that is reciprocatable by a bimetallic member, further comprising a device, influenced by a locking element, that is actuated by separate means such as the armature of a relay, for blocking the movable contact in its rest position as well as in its operating position by using a blocking member which is carried along by the slide.

In a known timing pulse generating switch of this kind, which is used in a monitoring circuit for oil burners, the slide actuates two snap switches of which, with continuous heating of the bimetallic member that adjusts the slide, the first operates at the end of the pre-ignition period and the second at the end of the safety period. On response of a photorelay actuated by the flame monitor, the movable contact of the first snap switch is to be blocked in that position which it happens to assume at that moment. For this purpose the relay armature is provided with a locking latch which co-operates with the free end of a lever of which the other end is fixed with respect to the housing and the central portion is carried along by the slide. During heating of the bimetallic member, the free lever end follows a path such that it is disposed on one side of the looking latch before the first snap switch switches over and on the other side after it has snapped over.

This construction requires a two-armed lever so that its free end co-operating with the locking latch traverses an adequately long distance. This calls for a correspondingly large structural size. When blocking takes place, as long as the movable contact of the first switch is in the rest position, the movement of the slide in impeded so that the safety switch cannot respond. Since the locking latch is disposed on the relay and the double-armed lever at the switch, accurate adjustment between two independent constructional elements is required in order to fix the relative position of the locking latch and lever.

It is also already known to allow the locking latch on the relay armature to engage directly on a contact arm which is adjusted with the aid of a snap system that consists of a snap arm and snap spring and that is driven by a bimetallic member by way of a slide. Here, the locking latch is provided with an inclined surface and the contact arm with a corresponding inclined surface. When the locking latch engages the inclined surface, considerable friction is set up. However, particularly serious difficulties arise in connection with the fact that with a small spacing of the movable contact from the fixed contact, as is desired for small differences, e.g. only 1.5 mm, the movement of the contact arm is insufficient to change from one side of the locking latch to the other side of the locking latch. This is all the more so because tolerances must be permitted to some minimum extent. This problem is described hereinafter in conjunction with FIG. 1.

The invention is based on the object of providing a time pulse generating switch of the aforementioned kind, in which the blocking is effected by direct engagement on the contact arm but the switch can nevertheless be designed with any desired, and particularly with a very small, difference and large tolerances can also be permitted.

This object is achieved by the invention in that the blocking member is a bolt which is mounted on the slide, is loaded by a return force and is displaceable by the locking element from its rest position transversely to the adjusting direction of the slide to a blocking position in which it may directly engage the contact arm.

With this construction, the bolt moves in synchronism with the slide but oppositely to the snapping motion of the snap or contact arm. Consequently there is not the slightest difficulty in allowing the bolt to become effective on one side of the contact arm in the rest position of the latter and on the other side of the contact arm in the operating position thereof. The spacing of the movable contact from its fixed contact that is so necessary for the difference of the switch is immaterial for this function. During assembly and during the material forming work comparatively large tolerances can also be permitted. In addition, the movement of the slide caused by the bimetallic member during heating or cooling tends to exert an additional force on the contact arm by way of the bolt, the contact arm ensuring certain contact during blocking in the rest or operating position. The precise position of the locking element, which may for example be actuated by a relay armature, is no longer critical with respect to the switch; one must only ensure that the locking element can somehow or other actuate the bolt.

A simple construction is obtained if the bolt is secured to the slide by means of a leaf spring which exerts the return force. The leaf spring then also effects the mounting and the return of the bolt. In particular, the bolt may be formed by a bent away extension of the spring leaf.

It is of advantage if the bolt is displaceable transversely to the contact arm. This construction is applicable even if the end of the contact arm is occupied by a snap spring. Also, this results in a compact construction.

Further, the leaf spring may extend towards the snap system substantially parallel to a side wall of the slide. In that case an actuating element, e.g. a relay, disposed adjacent the switch may actuate the leaf spring by means of a simple locking element that is adjustable transversely to the leaf spring. At most, a relatively coarse setting of the locking element is required in its direction of movement.

It is also favourable if the contact arm comprises a lateral extension near the contact extending up to the blocking position of the bolt. The bolt will then engage near the contact, i.e. at the position where the blocking forces are primarily required. The extension may also bridge certain spacings that are required for constructional reasons.

Further, the leaf spring may be displaceable by adjusting means relatively to the slide in the adjusting direction thereof. This adjusting arrangement permits the starting position of the bolt to be determined. This adjustment takes place merely between parts that belong to the switch. No adjustment is required between a separately actuated locking element and bolt.

Further, an adjustable end stop may be provided on the slide for determining the blocking position of the bolt.

A particularly compact construction is obtained if the slide is held at both ends by a respective spring, preferably a bimetallic spring, fixed with respect to the housing and the snap switch or switches as well as the bolt are disposed between the springs.

The invention will now be described in more detail with reference to an example shown in the drawing. In the drawing.

Figure 2:
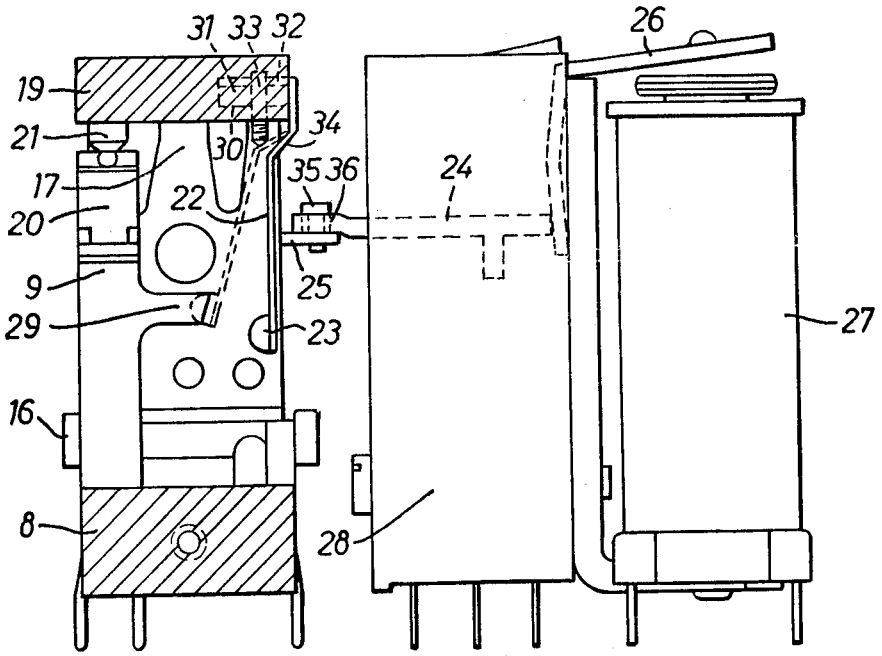
FIG. 2 is a part-sectional side elevation of a timing pulse generating switch according to the invention with the relay actuating the bolt.
Figure 1:
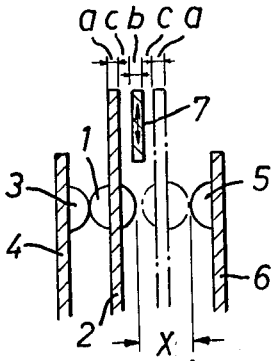
FIG. 1 is a diagrammatic section through the contact arrangement of a snap switch with a locking latch that is only movable in the direction of the arrow.

FIG. 1 shows a snap switch of which the movable contact 1 is fixed to a snappable contact arm 2 which lies against a first fixed contact 3 of an arm 4 in the rest position and a second fixed contact 5 of an arm 6 in the operating position. The latter condition is illustrated in chain-dotted lines. A locking latch or bolt 7 is introduceable in the direction of the arrow into the path of movement of the contact arm 2. In conncection with FIG. 1; it is assumed that this bolt is movable only in the direction of the arrow, which is not the subject of the present invention. The spacing $x$ between the movable contact 1 and the fixed contact 5 is then given by the sum $x = 2a + b + 2c$, wherein $a$ is the thickness of the metal of the contact arm 2, $b$ is the thickness of the metal of bolt 7 and $o$ is the tolerance required for inserting the bolt 7. It will be evident that the spacing x must not be less than a predetermined distance; the switch therefore hs a minimum difference which is often too large anyway. The choice of tolerances also presents difficulties. They must be very precise and small because with an excessive tolerance the spacing $x$ becomes still larger and the contact pressure is reduced in certain operating conditions.

Reference is now made to the embodiment of the invention according to FIGS. 2 to 10. Clamped in a housing 8 there are a contact arm 9 with a movable contact 10, two fixed arms 11 and 12 each having a fixed contact 13 and 14, as well as an electric conductor 15 for a heater 16. A heatable bimetallic spring 17 and a compensating bimetallic spring 18, which are likewise clamped in the housing 8, carry a slide 19 at their free end. The contact arm 9 consists of resilient material. It is articulated at its free end to a snap spring 20 which, in turn, rests in a joint 21 on the slide 19. If the slide 19 is deflected to the left hand side in FIG. 3 by heating of the bimetallic spring 17, the contact arm 9 snaps into the operating position of FIG. 5 after passing a dead centre position. A leaf spring 22 is secured to a side wall of the slide 19 and at its free end carries a bent away extension to form a bolt 23. With the aid of a locking element 24, which carries a small metal plate 25 at its front end, and by means of the hinged armature 26 of an adjacent relay with magnetic coil 27 and contact attachment 28, this spring 22 can be swung out of the position shown in full lines in FIG. 2 to the position shown in broken lines, where the bolt 23 is located in the path of an extension 29 on the contact arm 9.

The slide 19 contains a recess 30 into which a clamping plate 31 is inserted from the side. The clamping plate holds a bent away portion 32 of the leaf spring 22. An adjusting screw 33 passes through a screwthread in the clamping plate 31, a hole in the portion 32 and two slots (not shown) extending lengthwise of the slide 19 above and below the recess 30. The adjusting screw 33 co-operates with a step 34 in the leaf spring 22 in order to determine the operating position shown in broken lines. By displacing the clamping plate 31 by means of the leaf spring 22 and the adjusting screw 33 in the recess 30, the starting position of the bolt 23 can be determined. The metal plate 25 has a screwthread for a screw 35 which passes through an elongated hole 36 in the locking element 24. One can therefore adjust the metal plate 25 axially with respect to the locking element 24.

Figure 7:
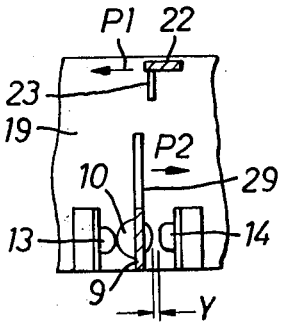
FIGS. 7 to 10 are sections on the line A—A of FIG. 3 corresponding to FIGS. 3 to 6.
Figure 3:
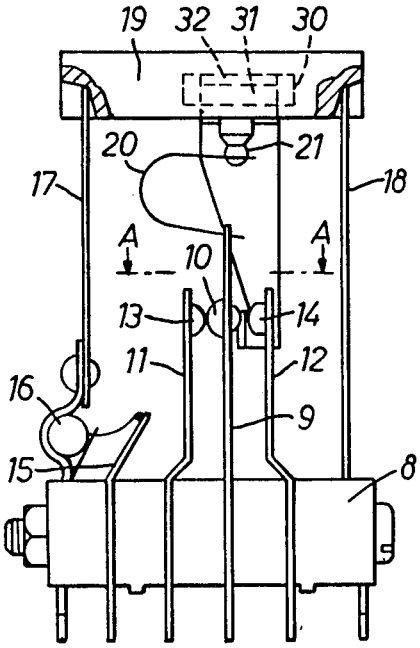
FIGS. 3 to 6 are side elevations of the timing pulse generating switch in different operating positions.

This results in the following manner of operation:

1. The heating element 16 is not heated, the bolt is not actuated (FIG. 3 and 7). This results in a predetermined spacing $y$ between the movable contact 10 and the fixed contact 14. This spacing $y$ may be kept comparatively small. The difference of the switch is correspondingly small. Upon heating, the slide 19 moves towards the left in the direction of the arrow P1 until, after a predetermined distance, the contact arm 9 snaps over to the right in the direction of the arrow P2.

Figure 8:
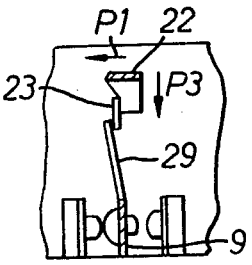
Figure 4:
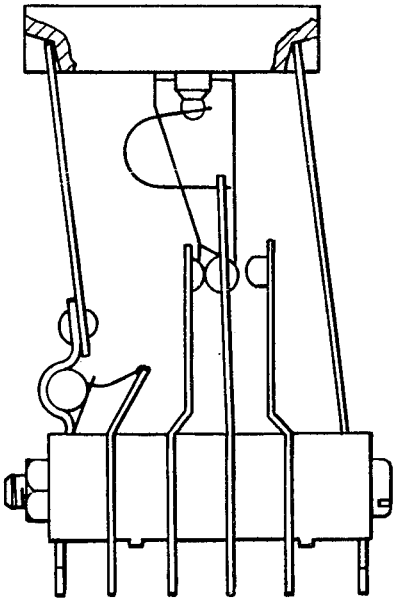

2. The heating element is heated and the bolt is simultaneously actuated (FIGS. 4 and 8). On actuation of the bolt 23, the latter is displaced in the direction of the arrow P3. As a result of the slide movement in the direction of the arrow P1, the bolt 23 engages the extension 29 of the contact arm 9, this possibly resulting in resilient bending of the extension 29 and even the arms 9 and 11. Even on more intense heating and corresponding displacement of the slide 19, the movable contact remains in its rest position with a possible increase in the contact pressure.

Figure 9:
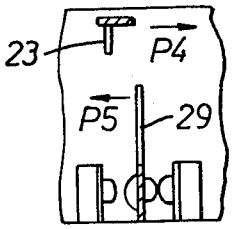
Figure 5:
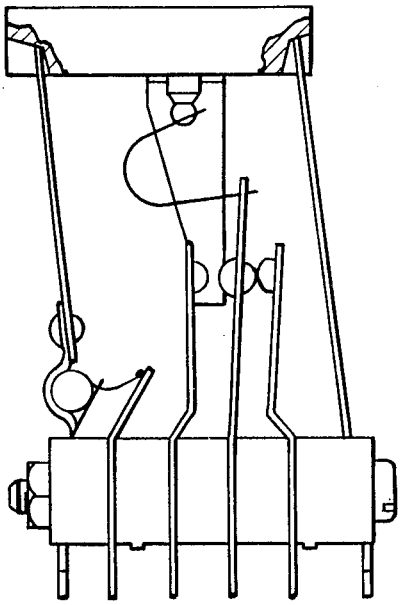

3. The heating element is heated and the bolt is not actuated (FIGS. 5 and 9). This is the normal operating position at which the contact arm 9 has snapped from its rest position in FIG. 3 to the operating position of FIG. 5. Upon cooling, the slide 19 returns to the rest position in the direction of the arrow P4 against the direction of the arrow P1, the contact arm, after passing a dead center position, snapping back to the rest position in the direction of the arrow P5, i.e. against the direction of the arrow P2.

Figure 10:
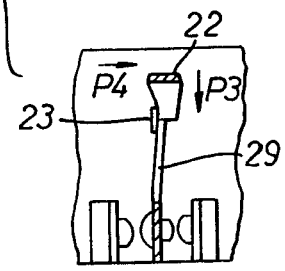
Figure 6:
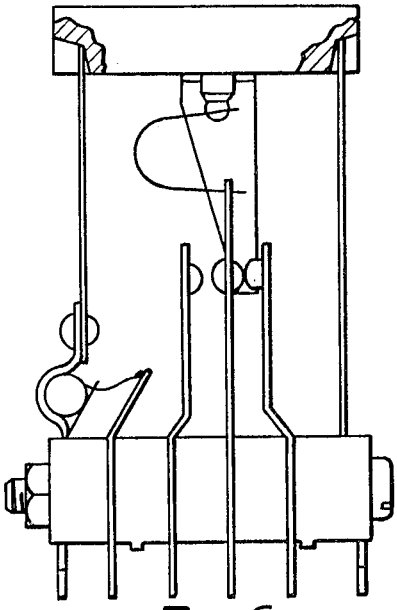

4. The bolt is actuated after the contact arm had been brought to the operating position and the heating element had no longer been heated (FIGS. 6 and 10). The bolt 23 displaced in the direction of the arrow P3 now engages the other side of the extension 29 so that, during return movement of the slide 19 in the direction of the arrow P4, the contact arm 9 is held in its operating position, the extension 29 or the arms 9 and 12 being adapted to yield resiliently and a higher contact pressure being achievable. If the bolt 23 is withdrawn from this position when the relay drops off, the contact arm 9 jumps back to the rest position.

The construction is also suitable for other snap systems, for example those in which a helical tension spring is used instead of a U-shaped compression spring as the snap spring. It is also for snap switches in which a contact is made only in one position. The bolt 23 may also be mounted for movement perpendicular to the slide 19.

We claim:

1. A timing pulse generating switch assembly comprising housing and slide members in spaced apart relation, bimetallic spring means connecting said members to provide relative movement therebetween with said slide member having an at rest position and an operative position, three contact arms carrying contacts attached to said housing, a snap spring between the center one of said arms and said slide member, a blocking member carried by said slide member which is actuatable relative to said slide member from an inoperative nonblocking position to an operative blocking position, said blocking position being selectively between said center one of said arms and a selected one of said other two arms to selectively block the initial movement of said center arm or the return movement of said center arm, and means for actuating said blocking member.

2. A timing pulse generating switch assembly in accordance with claim 1 wherein a leaf spring connects said blocking member to said slide member.

3. A timing pulse generating switch assembly in accordance with claim 2 wherein said blocking member is a flange formed on said leaf spring.

4. A timing pulse generating switch assembly in accordance with claim 1 wherein said blocking member is movable transversely relative to the movement of said slide member.

* * * * *